US010106960B2

(12) United States Patent
Jeske et al.

(10) Patent No.: US 10,106,960 B2
(45) Date of Patent: Oct. 23, 2018

(54) LOCK ASSEMBLY FOR GROUND ENGAGING TOOL

(71) Applicant: Caterpillar Inc., Peoria, IL (US)

(72) Inventors: Clifford Otto Jeske, Brimfield, IL (US); Brian Thomas Rimmey, Morton, IL (US); Nathan Bjerke, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 177 days.

(21) Appl. No.: 15/333,405

(22) Filed: Oct. 25, 2016

(65) Prior Publication Data

US 2017/0145665 A1 May 25, 2017

Related U.S. Application Data

(60) Provisional application No. 62/260,145, filed on Nov. 25, 2015.

(51) Int. Cl.
*E02F 9/28* (2006.01)

(52) U.S. Cl.
CPC ..... *E02F 9/2841* (2013.01); *E02F 9/285* (2013.01); *E02F 9/2825* (2013.01); *E02F 9/2858* (2013.01); *E02F 9/2883* (2013.01)

(58) Field of Classification Search
CPC ..... E02F 9/2841; E02F 9/285; E02F 9/2858; E02F 9/2883
See application file for complete search history.

(56) References Cited

U.S. PATENT DOCUMENTS

| | | | | | |
|---|---|---|---|---|---|
| 3,312,004 | A * | 4/1967 | Johnson | E02F 9/2841 | 37/457 |
| 4,213,257 | A * | 7/1980 | Johansson | E02F 9/2841 | 299/109 |
| 4,611,418 | A * | 9/1986 | Launder | E02F 9/2841 | 172/750 |
| 4,761,900 | A * | 8/1988 | Emrich | E02F 9/2841 | 37/457 |
| 4,811,505 | A * | 3/1989 | Emrich | E02F 9/2841 | 37/457 |
| 4,823,487 | A * | 4/1989 | Robinson | E02F 9/2841 | 37/457 |
| RE33,042 | E * | 9/1989 | Emrich | E02F 9/2841 | 37/459 |
| 4,965,945 | A * | 10/1990 | Emrich | E02F 9/2841 | 37/456 |
| 5,709,043 | A | 1/1998 | Jones et al. | | |

(Continued)

FOREIGN PATENT DOCUMENTS

| | | |
|---|---|---|
| CN | 101153497 | 4/2008 |
| WO | 2013030335 | 3/2013 |

*Primary Examiner* — Matthew D. Troutman
(74) *Attorney, Agent, or Firm* — Procopio, Cory, Hargreaves & Savitch LLP

(57) ABSTRACT

A lock assembly includes a compressible base. The compressible base includes a front face and a back face. The front face and the back face may each have a noncircular shape. The lock assembly includes a rigid latch member extending from the front face of the compressible base. The latch member includes a ramp extending away from the front face. The ramp may have a low end and an elevated end, the elevated end extending further away from the front face than the low end. The latch member includes a tool engaging feature extending into the ramp.

20 Claims, 3 Drawing Sheets

(56) References Cited

U.S. PATENT DOCUMENTS

| | | | | |
|---|---|---|---|---|
| 5,937,550 | A * | 8/1999 | Emrich | E02F 9/2841 37/458 |
| 6,059,531 | A * | 5/2000 | Tai | F04D 29/34 403/326 |
| 6,220,778 | B1 * | 4/2001 | Suchanek | H01H 9/02 24/613 |
| 6,378,824 | B1 * | 4/2002 | Tseng | F04D 25/088 248/220.21 |
| 7,008,192 | B2 * | 3/2006 | Hidalgo | F04D 25/088 416/206 |
| 7,086,185 | B2 | 8/2006 | Pasqualini et al. | |
| 7,178,274 | B2 | 2/2007 | Emrich | |
| 7,882,649 | B2 * | 2/2011 | Carpenter | E02F 9/28 37/452 |
| 8,122,623 | B1 | 2/2012 | Hughes | |
| 8,925,221 | B2 | 1/2015 | Jeske | |
| 9,057,177 | B2 | 6/2015 | Renski et al. | |
| 9,062,436 | B2 | 6/2015 | Renski et al. | |
| 9,650,764 | B2 * | 5/2017 | Carpenter | E02F 9/28 |
| 2008/0256832 | A1 | 10/2008 | Esti | |
| 2012/0304507 | A1 * | 12/2012 | Ko | E02F 9/2825 37/455 |
| 2013/0152433 | A1 | 6/2013 | Itou et al. | |
| 2014/0259810 | A1 | 9/2014 | LaHood | |
| 2014/0352182 | A1 | 12/2014 | LaHood et al. | |

* cited by examiner

LOCK ASSEMBLY FOR GROUND ENGAGING TOOL

TECHNICAL FIELD

This disclosure relates generally to ground engaging tools, and more particularly, to a lock assembly for removably attaching ground engaging tools.

BACKGROUND

Earth-working machines, such as, for example, excavators, wheel loaders, hydraulic mining shovels, cable shovels, bucket wheels, bulldozers, and draglines, are generally used for digging or ripping into the earth or rock and/or moving loosened work material from one place to another at a worksite. These earth-working machines include various earth-working implements, such as a bucket or a blade, for excavating or moving the work material. These implements can be subjected to extreme wear from the abrasion and impacts experienced during the earth-working applications. To protect these implements against wear, and thereby prolong the useful life of the implements, various ground engaging tools, such as teeth, edge protectors, and other wear members, can be provided to the earth-working implements in the areas where the most damaging abrasions and impacts occur. These ground engaging tools are removably attached to the implements using lock assemblies, so that worn or damaged ground engaging tools can be readily removed and replaced with new ground engaging tools.

U.S. Pat. No. 7,178,274 to Emrich is directed to a coupling arrangement for securing two separable components in an excavating operation. The coupling arrangement includes a wear component, a base component and a lock. The lock has a body having a configuration adapted to be received in a hole in the base component, and a rotatable locking member. The locking member includes a flange that is movable between a locking position wherein the flange holds the lock in the assembly and a release position wherein the flange permits the lock to be removed from the assembly. In the release position, the flange sets within the axial extension of the outline of the body. In the locking position, at least part of the flange sets outside the axial extension of the outline of the body. In one construction, the rotation of the locking member to the locking position tightens the fit of the wear component on the base component.

The present disclosure is directed toward overcoming one or more of the problems discovered by the inventors or that is known in the art.

SUMMARY OF THE DISCLOSURE

In one embodiment, a lock assembly for securing a wear member to an implement is provided. The lock assembly includes a compressible base. The compressible base includes a front face and a back face opposite the front face. The front face and the back face may each have a noncircular shape. The lock assembly includes a rigid latch member extending from the front face of the compressible base. The latch member includes a ramp extending away from the front face. The ramp may have a low end and an elevated end, the elevated end extending further away from the front face than the low end. The latch member includes a ramp surface extending between the low end and the elevated end. The latch member includes a tool engaging feature extending into the ramp.

In another embodiment, an implement and lock assembly is provided. The implement and lock assembly includes an implement. The implement includes an aperture extending through a tapered end of the implement. The lock assembly includes a compressible base. The compressible base includes a front face and a back face opposite the front face. The front face and the back face may each have a noncircular shape. The lock assembly includes a rigid latch member extending from the front face of the compressible base. The latch member includes a ramp extending away from the front face. The ramp may have a low end and an elevated end, the elevated end extending further away from the front face than the low end. The latch member includes a ramp surface extending between the low end and the elevated end. The latch member includes a tool engaging feature extending into the ramp. The shape of the aperture may match the shape of the compressible base.

In yet another embodiment, a lock assembly for securing a wear member to an implement is provided. The implement may have an aperture extending through a tapered end. The wear member may have a lock aperture concentric to the aperture of the implement. The lock assembly includes a compressible base insertable into the aperture of the implement. The compressible base may be in the shape of a right prism having rounded corner edges. The rounded corner edges may be configured to resist rotation of the compressible base within the aperture. The lock assembly includes a latch member extending from the compressible base. The latch member includes a ramp extending away from the compressible base and configured to align with the lock aperture. The ramp may have a low end and an elevated end. The elevated end may extend further away from the base than the low end. The elevated end may be configured to brace against the lock aperture. The latch member includes a ramp surface extending between the low end and the elevated end. The latch member includes a tool engaging feature extending into the ramp.

BRIEF DESCRIPTION OF THE DRAWINGS

The details of embodiments of the present disclosure, both as to their structure and operation, can be gleaned in part by study of the accompanying drawings, in which like reference numerals refer to like parts, and in which.

DETAILED DESCRIPTION

This disclosure relates to a lock assembly for securing ground engaging tools. The lock assembly may include a base and a latch member attached to the base. The base may be compressible in at least two directions. In some embodiments, the base is compressible in an axial direction and in a rotational direction. Further, the base may have certain features that resist rotational movement. The base may be inserted into an aperture of an implement, such as a ripper shank. The latch member may extend into an aperture of a wear member, such as a ripper tip. The latch member may prevent reverse movement of the wear member from the implement. The latch member may include a tool engaging feature to provide a torqueable surface to rotate the base within the aperture of the implement. The base may be rotated from a first position to a second position or vice versa to allow for attachment of the implement and the wear member or decoupling of the implement and the wear member.

Figure 1:
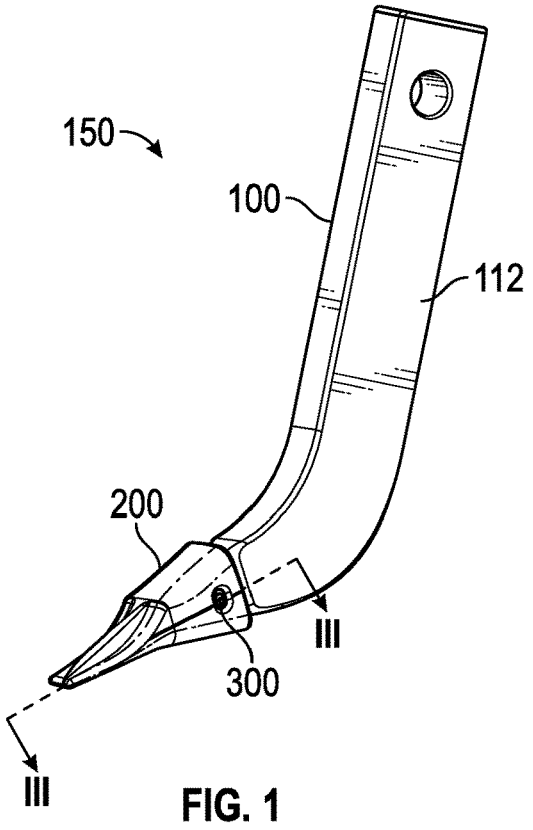
FIG. 1 is a perspective view of an embodiment of an implement assembly.

FIG. 1 is a perspective view of an implement assembly 150 according to an embodiment of the present disclosure. As shown in the figure, implement assembly 150 may include an implement 100, a wear member 200, and a lock assembly (also referred to herein as a retention assembly) 300. Implement 100 may be a ripper shank, an adapter, a blade, a base edge, a bucket, or a similar earthworking apparatus. Wear member 200 may be a ripper tip, a cutting edge, a corner protector, a side protector, a tooth coupler, or similar wear members. Implement 100 may be an elongated member having a straight upper portion 112 extending to a curved middle portion 110 abutting a tapered end 102 (see FIG. 2). Tapered end 102 may include a pair of apertures for receiving a pair of lock assemblies 300, as will be discussed in FIG. 2. Wear member 200 may be rigid hollow component having a cavity 208 to receive one end of implement 100 (see FIG. 3). Tapered end 102 of implement 100 may be inserted into cavity 208 of wear member 200 (see FIG. 3). Wear member 200 may also include a pair of apertures for receiving the pair of lock assemblies 300. One of the lock assemblies 300 is shown inserted into one of the apertures of both wear member 200 and implement 100.

Figure 2:
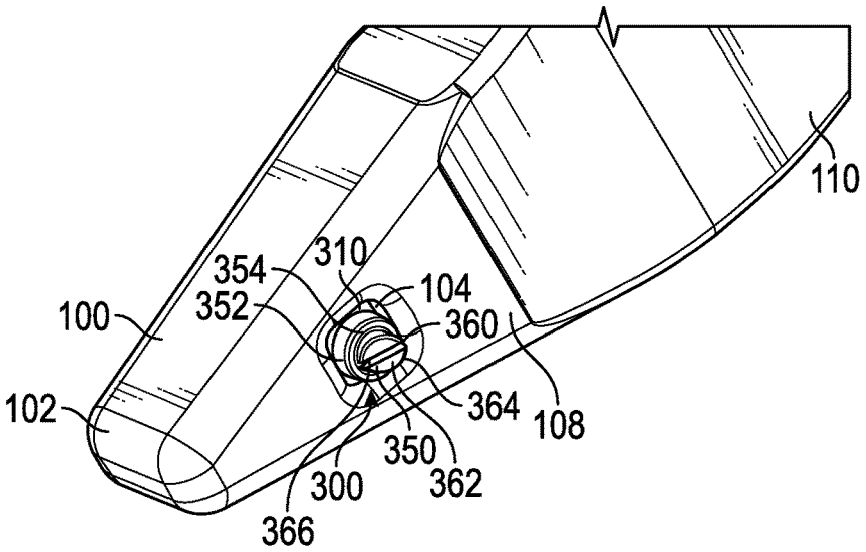
FIG. 2 is a detailed view of a portion of the implement of FIG. 1 assembled with a lock assembly.

FIG. 2 is a detailed view of a portion of the implement 100 of FIG. 1 assembled with lock assembly 300. As shown, implement 100 may include a first aperture 104 extending a certain depth from a lateral side 108 at one side of implement 100. A similar second aperture 106 may be located at the opposite side of implement 100 (see FIG. 3). In some embodiments, first aperture 104 has a square cross section. In some embodiments, first aperture 104 may have rounded corners and/or rounded sides. In further embodiments, the shape of first aperture 104 may match the shape of a base 310 of lock assembly 300.

Figure 6:
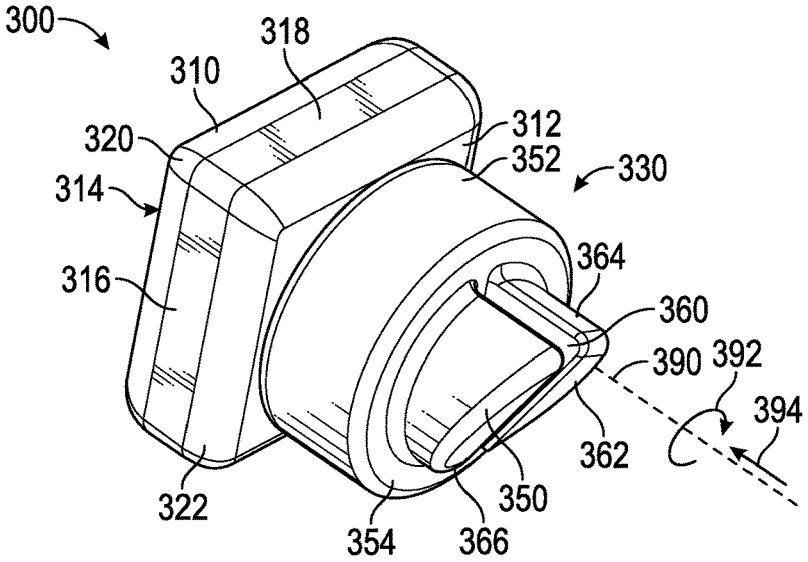
FIG. 6 is a perspective view of a lock assembly.

Lock assembly 300 may be inserted into first aperture 104. Referring also to FIG. 6, lock assembly 300 may include a base 310 and a latch member 330. Latch member 330 may include a mounting member 352 and a latch portion 350. Mounting member 352 may be fixably coupled to base 310. Mounting member 352 may extend away from a front face of base 310 (see FIG. 6). In some embodiments, mounting member 352 and base 310 are coupled by an adhesive. Mounting member 352 and base 310 may be coupled by and adhesive, such as for example, a glue. In some embodiments, mounting member 352 and base 310 can be coupled together by press fitting. Mounting member 352 may be a cylindrical or other round structure that is symmetrical about at least one axis. In some embodiments, mounting member 352 may be a rectangular prism. In some embodiments, the compressible base 100 can be a rectangular prism or other regular shaped structure (e.g., a hexagonal prism). Mounting member 352 may include an outer face 354 opposite from base 310. Latch portion 350 may extend from outer face 354 of mounting member 352 in a direction opposite from base 310. Latch portion 350 may be formed integrally with mounting member 352. In some embodiments, latch portion 350 is a rigid ramp structure having a low end 366 and an elevated end 364 opposite from the low end 366.

Latch portion 350 may have a ramp surface 362 extending between low end 366 to elevated end 364. In some embodiments, ramp surface 362 is planar, as shown in the figures. In other embodiments, ramp surface 362 is curved. Latch portion 350 may also include a tool engaging feature 360 extending through the ramp structure. Tool engaging feature 360 may be configured to receive a tool. The tool may be used to provide torque to the tool engaging feature 360 in order to rotate the lock assembly 300. In some embodiments, the tool engaging feature 360 is a groove extending from the low end 366 to the elevated end 364.

Base 310 may be inserted into first aperture 104 in which base 310 faces the back of first aperture 104. Base 310 may be shaped to interference fit with the walls of first aperture 104. The shape of base 310 is described in connection with FIG. 6, below. Base 310 may be composed of a material to allow for the interference fit with the walls of first aperture 104. In some embodiments, the base 310 may be formed of a compressible and resilient material. In some other embodiments, the base 310 may be formed of a porous material. In some other embodiments, the base 310 may be compressible in one direction with minimal or no expansion in a second direction. In some embodiments, base 310 is composed of rubber, or another elastomeric polymers. In some other embodiments, base 310 is composed of foam. In some embodiments, base 310 is composed of a microcellular polyurethane elastomer. In some embodiments, base 310 is composed of Cellasto. In some embodiments, base 310 has a compression ratio configured to resist rotation within first aperture 104 during operation of a machine. In some embodiments, base 310 has a compression ratio configured to remain intact during rotation within first aperture 104 by a tool. In some embodiments, base 310 has a hardness factor configured to remain intact during rotation within first aperture 104 by a tool. In some embodiments, base 310 is a spring.

Latch portion 350 may extend outwards from lateral side 108. Latch portion 350 may be received by features of wear member 200, as will be discussed in FIG. 3 below.

Figure 3:
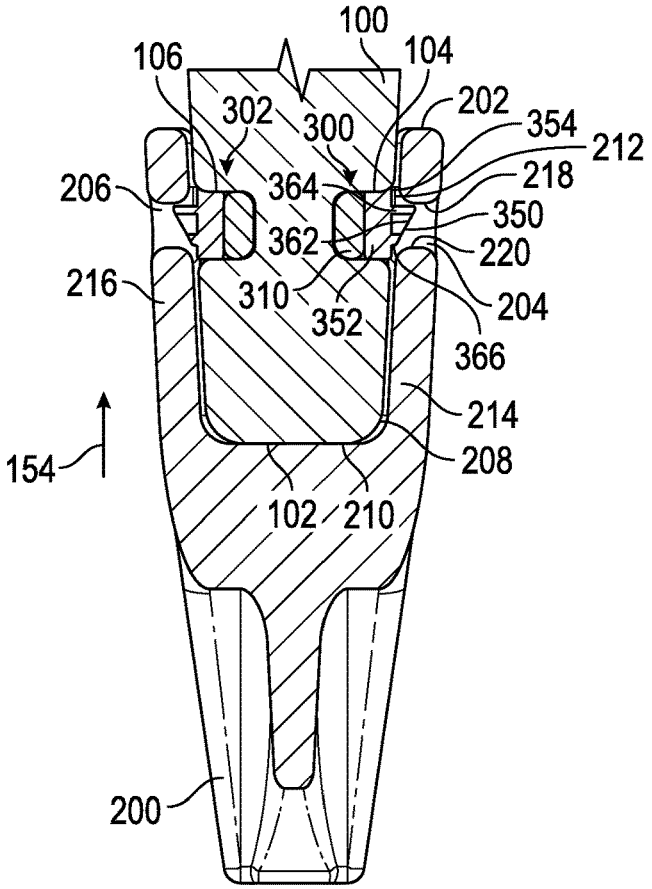
FIG. 3 is a cross sectional view of a portion of the implement assembly of FIG. 1 taken along line III-III.

FIG. 3 is a cross sectional view of a portion of implement assembly 150 of FIG. 1 taken along line Wear member 200 may include a cavity 208 having a cavity end 210. Furthermore, wear member 200 may include a first lock aperture 204 extending through a first wall 214, and a second lock aperture 206 extending through a second wall 216 opposite from first wall 214. First wall 214 may have an inner cavity surface 212 along the interior of first wall 214. First lock aperture 204 may feature an inner aperture face 218 and an outer aperture face 220 opposite from inner aperture face 218. First lock aperture 204 and second lock aperture 206 may both extend into cavity 208.

As shown in the figure, tapered end 102 of implement 100 may be inserted into cavity 208 towards cavity end 210. Tapered end 102 may abut cavity end 210. As described above in FIG. 2, lock assembly 300 may be inserted into first aperture 104. Base 310 may be coupled to first aperture 104 by an interference fit. The interference fit may not be so restrictive that base 310 is unremovable from first aperture 104. Furthermore, mounting member 352 may fit within first aperture 104. The width (or diameter) of mounting member 352 may be greater than the width of first lock aperture 204. This may prevent lock assembly 300 from escaping first aperture 104. Outer face 354 may be adjacent to inner cavity surface 212. In some embodiments, outer face 354 may abut inner cavity surface 212. The tight clearance between outer face 354 and inner cavity surface 212 may also prevent lock assembly 300 from escaping first aperture 104.

As shown in the figure, first lock aperture 204 may be concentric to first aperture 104. In addition, latch portion 350 of lock assembly 300 may be aligned to first lock aperture 204. Latch portion 350 may extend into first lock aperture 204. Additionally, elevated end 364 of latch portion 350 may be adjacent inner aperture face 218. In some embodiments, a small clearance may be formed between elevated end 364 and inner aperture face 218. In some embodiments, elevated end 364 abuts inner aperture face 218. Elevated end 364 may provide a broad surface to brace against inner aperture face 218.

A second lock assembly 302 may be inserted into second aperture 106. Second lock assembly 302 may be similarly oriented with respect to second lock aperture 206 as lock assembly 300 is to first lock aperture 204.

Figure 4:
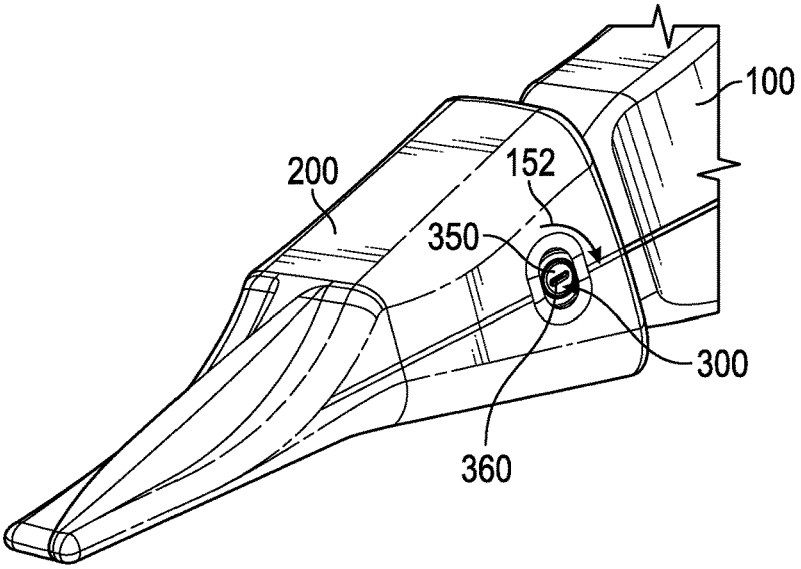
FIG. 4 is a detailed perspective view of a portion of the implement assembly of FIG. 1.

FIG. 4 is a detailed perspective view of a portion of implement assembly 150 of FIG. 1. Lock assembly 300 may be rotatable within first aperture 104 (see FIG. 2). Lock assembly 300 may be rotated by rotating tool engaging feature 360 of latch portion 350. More details regarding the rotation of lock assembly 300 a discussed below.

Figure 5:
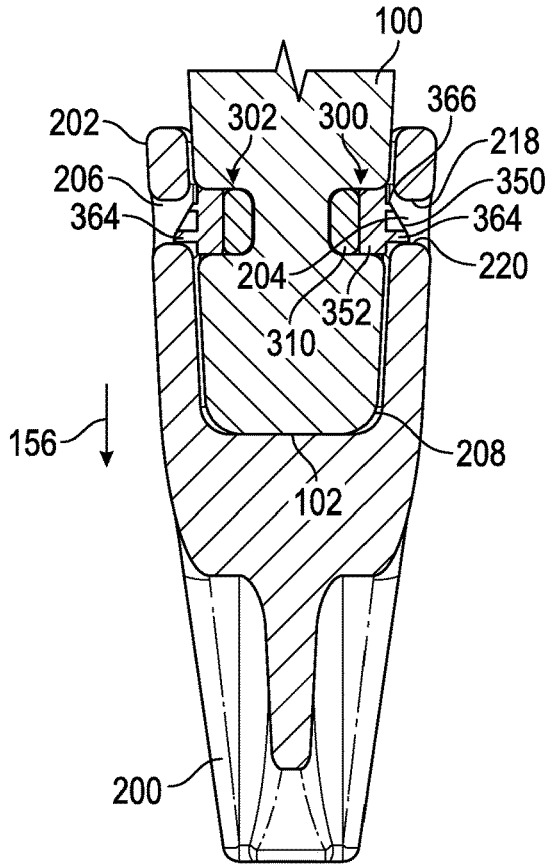
FIG. 5 is a cross sectional view of the portion of the implement assembly of FIG. 3 having the lock assembly rotated 180 degrees.

FIG. 5 is a cross sectional view of the portion of implement assembly 150 of FIG. 3 having lock assembly 300 rotated 180 degrees. As shown in this orientation, low end 366 may be adjacent inner aperture face 218. Low end 366 may provide little to no resistance against inner aperture face 218. This may allow for implement 100 to release from wear member 200.

FIG. 6 is a perspective view of lock assembly 300. In some embodiments, base 310 has the shape of a prism having six faces. Base 310 may be a polyhedron possessing two congruent polygonal faces, such as a front face 312 and a back face 314 opposite front face 312, and with all remaining faces rectangles. Base 310 may be a hexahedron. As shown in the figure, front face 312 and back face 314 are rectangles. As such, base 310 can have the shape of a rectangular prism (also known as a cuboid). The shape of front face 312 and back face 314 may be rotationally symmetric. As such, the shape of front face 312 and back face 314 may be regular (or equiangular) polygons. For example, the shape of front face 312 and back face 314 are regular triangles, pentagons, hexagons, heptagons, octagons, or other polygons.

In some embodiments, the shape of front face 312 and back face 314 may be a digon. In some embodiments, the shape of front face 312 and back face 314 are oval. In some embodiments, the shape of front face 312 and back face 314 are not circles.

In some embodiments, all of the faces of base 310 are straight, such as front face 312 and back face 314. In other embodiments, some of the faces of base 310 are curved in at least one direction. In some embodiments, some of the faces of base 310 are curved in two directions.

Base 310 may have a plurality of corner edges and a plurality of side edges, in which some of them may be rounded. For example, a top left corner edge 320 may be formed between a left face 316 and a top face 318. As shown, top left corner edge 320 is rounded. As another example, a left front side edge 322 may be formed between front face 312 and left face 316. As shown, left front side edge 322 is rounded. Further, left front side edge 322 may have a large round.

In some embodiments, a plurality of small semi-circular or semi-elliptical nubs or bulges may extend around the periphery of base 310 (not shown). For example, the plurality of nubs may extend from left face 316, top face 318, a right face (not shown), and a bottom face (not shown). The plurality of nubs may assist in preventing rotation of base 310.

Base 310 may be shaped to prevent certain rotation of base 310 within an aperture, such as first aperture 104 of implement 100. The sides and corners of base 310 may provide frictional resistance against the walls of first aperture 104. In such embodiments, base 310 may be shaped to only allow rotation within first aperture 104 from sufficient rotational forces above a certain threshold. Sufficient rotational forces above the threshold may be applied by a tool, such as by rotating a flathead screwdriver within tool engaging feature 360 of latch portion 350. A breaker bar with a square drive may also be used to rotate tool engaging feature 360.

As described above, base 310 may be composed of a compressible and resilient material. Base 310 may be compressible in at least an axial direction and a rotational direction. For example, base 310 may be aligned to an axis 390. Axis 390 may be defined by the central axis of mounting member 352. Base 310 may be compressible in a rotational direction of arrow 392. In such embodiments, base 310 may be compressible at its corners, such as at left top corner edge 320. Furthermore, base 310 may be compressible in an axial direction of arrow 394. In such embodiments, base 310 may be compressible at its faces, such as front face 312. In further embodiments, all faces of base 310 are compressible. In further embodiments, all corners of base 310 are compressible.

INDUSTRIAL APPLICABILITY

The present disclosure generally applies to ground engaging tools and a lock assembly for ground engaging tools. The disclosed ground engaging tools, such as a wear member, may be applicable to various earth-working machines, such as, for example, excavators, wheel loaders, hydraulic mining shovels, cable shovels, bucket wheels, bulldozers, and draglines. Ground engaging tools, such as wear member 200, may be attached to an implement, such as implement 100. Wear member 200 may be used to penetrate earth. The wear members may undergo severe impact and constant wear, resulting in damaged wear members. A lock assembly, such as lock assembly 300, may be used for convenient coupling and decoupling of implement 100 to wear member 200.

FIGS. 3-5 illustrate the coupling and decoupling of implement 100 to wear member 200. FIG. 3 illustrates wear member 200 coupled to implement 100 by lock assembly 300. To couple wear member 200 and implement 100, lock assembly 300 may first be inserted into first aperture 104 of implement 100 (see FIG. 2). Lock assembly 300 may be oriented in a first position. In the first position, elevated end 364 of latch portion 350 may be facing the same direction as the direction of the disposing of cavity 208 onto implement 100, as indicated by arrow 154.

As cavity 208 is disposed onto implement 100, low end 366 of latch portion 350 may abut an outer end 202 of wear member 200. Outer end 202 may apply a resistance force against low end 366 in a direction perpendicular to the angle of ramp surface 362. This force may be transferred through latch portion 350 to base 310. Due to the compressibility of base 310, the force applied by outer end 202 may compress base 310 and bias front face 312 inwards (see arrow 394 of FIG. 6) into first aperture 104. As cavity 208 slides further onto implement 100 in the direction of arrow 154, outer end 202 abuts an increasingly elevated portion of latch portion 350. In turn, front face 312 of base 310 may be compressed further inwards into first aperture 104. Just before tapered end 102 reaches cavity end 210, outer end 202 may abut elevated end 364 and compress base 310 further inwards causing elevated end 364 to tuck into cavity 208. As such, elevated end 364 may slide along inner cavity surface 212 as cavity 208 disposes onto implement 100. Elevated end 364 may continue to slide along inner cavity surface 212 until elevated end 364 springs out into first lock aperture 204. At this position, elevated end 364 may face inner aperture face 218. Elevated end 364 may provide a broad surface to brace against inner aperture face 218, preventing implement 100 from releasing out of wear member 200 in the opposite direction of arrow 154.

Second lock assembly 302 may undergo a similar process during coupling of implement 100 to wear member 200.

To decouple implement 100 from wear member 200, lock assembly 300 may be rotated to a second position. FIGS. 4 and 5 illustrate this process. Due to the shape of base 310, base 310 may resist rotation within first aperture 104. In particular, the corners of base 310 may provide frictional resistance against the corresponding corners of first aperture 104. This frictional resistance can be useful in preventing base 310 from freely rotating within first aperture 104 during operation of implement assembly 150. However, base 310 may require to be rotated in order to decouple implement 100 from wear member 200. Due to the rotational compressibility of base 310, sufficient torque may be applied to the corners of base 310 to compress base 310 inwards to overcome the frictional resistance forces. This may allow for rotation of base 310. Sufficient torque may be applied by rotating a tool within tool engaging feature 360 of latch portion 350. The walls of tool engaging feature 360 of lock assembly 300 may provide torqueable surfaces to rotate latch portion 350. A tool, such as a flathead screwdriver, may be used to generate sufficient torque.

The tool may rotate tool engaging feature 360 in a direction of arrow 152, or in an opposite direction. Tool engaging feature 360 may be rotated so that elevated end 364 no longer faces inner aperture face 218. In some embodiments, tool engaging feature 360 is rotated 180 degrees. At this position, elevated end 364 may face the opposite direction of arrow 154 of FIG. 3. This position can be seen in FIG. 5. At this position, implement 100 may be decoupled from wear member 200 by pulling implement 100 in a direction of arrow 156. Latch portion 350 may undergo a similar process during decoupling of implement 100 and wear member 200 as during coupling of implement 100 and wear member 200. In particular, ramp surface 362 may abut against inner aperture face 218 which causes base 310 to compress. Ramp surface 362 may abut against inner aperture face 218 from low end 366 to elevated end 364 until elevated end 364 is tucked against inner cavity surface 212. Elevated end 364 may continue to slide along inner cavity surface 212 until elevated end 364 releases out past outer end 202.

Second lock assembly 302 may similarly be rotated to a second position to allow for decoupling of implement 100 and wear member 200.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A lock assembly for securing a wear member to an implement, the lock assembly comprising:
- a compressible base including
  - a front face and a back face opposite the front face, the front face and the back face each having a noncircular shape; and
- a rigid latch member extending from the front face of the compressible base, the latch member including
  - a ramp having
    - a low end and an elevated end, the elevated end extending further away from the front face than the low end,
    - a ramp surface extending between the low end and the elevated end, and
    - a tool engaging feature extending into the ramp.

2. The lock assembly of claim 1, wherein the front face is compressible towards the back face.

3. The lock assembly of claim 1, wherein the front face and the back face each have a regular polygonal shape.

4. The lock assembly of claim 1, wherein the compressible base has a shape of a prism.

5. The lock assembly of claim 1, wherein the compressible base is composed of a compressible foam.

6. The lock assembly of claim 1, wherein the noncircular shape of the front face and the back face provide frictional resistance against rotation of the compressible base within an aperture of the implement.

7. The lock assembly of claim 6, wherein the compressible base is coupleable to the aperture of the implement by an interference fit.

8. The lock assembly of claim 6, wherein the compressible base is rotatable within the aperture by applying sufficient torque to compress the compressible base.

9. The lock assembly of claim 8, wherein sufficient torque is applied by rotating the tool engaging feature.

10. An implement and lock assembly comprising:
- an implement including
  - an aperture extending through a tapered end of the implement;

a lock assembly including a compressible base insertable into the aperture, the compressible base including a front face and a back face opposite the front face, the front face and the back face each having a noncircular shape, and a latch member extending from the front face of the compressible base, the latch member including a ramp having a low end and an elevated end, the elevated end extending further away from the front face than the low end, a ramp surface extending between the low end and the elevated end, and a tool engaging feature extending into the ramp; and wherein the shape of the aperture matches the shape of the compressible base.

11. The implement and lock assembly of claim 10, wherein the compressible base is inserted and coupled to the aperture by an interference fit.

12. The implement and lock assembly of claim 10, wherein the noncircular shape of the front face and the back face provide frictional resistance against rotation of the compressible base within the aperture.

13. The implement and lock assembly of claim 11, wherein the compressible base is rotatable within the aperture by applying sufficient torque to compress the compressible base.

14. The implement and lock assembly of claim 10, further comprising a wear member having a cavity, the tapered end of the implement inserted into the cavity.

15. The implement and lock assembly of claim 14, wherein the wear member further includes a lock aperture concentric to the aperture of the implement, the ramp of the latch member extending into the lock aperture.

16. The implement and lock assembly of claim 15, wherein the lock aperture includes an inner aperture face, the elevated end of the ramp adjacent the inner aperture face.

17. A lock assembly for securing a wear member to a implement, the implement having an aperture extending through a tapered end, the wear member having a lock aperture concentric to the aperture of the implement, the lock assembly comprising:

a compressible base insertable into the aperture of the implement, the compressible base having the shape of a right prism having rounded corner edges, the rounded corner edges configured to resist rotation of the compressible base within the aperture; and a latch member extending from the compressible base, the latch member including a ramp extending away from the compressible base and configured to align with the lock aperture, the ramp having a low end and an elevated end, the elevated end extending further away from the base than the low end, the elevated end configured to brace against the lock aperture, a ramp surface extending between the low end and the elevated end, and a tool engaging feature extending into the ramp.

18. The lock assembly of claim 17, wherein the compressible base is composed of a compressible foam.

19. The lock assembly of claim 17, wherein the compressible base is rotatable within the aperture by applying sufficient torque to compress the rounded corner edges.

20. The lock assembly of claim 17, wherein the latch member defines a central axis, the base compressible in the axial direction of the central axis and compressible in the rotational direction of the central axis.

* * * * *